US005620340A

United States Patent [19]

Andrews

[11] Patent Number: 5,620,340

[45] Date of Patent: Apr. 15, 1997

[54] CONNECTOR WITH IMPROVED SHIELDING

[75] Inventor: Derek Andrews, Vinkel, Netherlands

[73] Assignee: Berg Technology, Inc., Reno, Nev.

[21] Appl. No.: 454,397

[22] PCT Filed: Dec. 30, 1993

[86] PCT No.: PCT/US93/12673

§ 371 Date: Jun. 20, 1995

§ 102(e) Date: Jun. 20, 1995

[87] PCT Pub. No.: WO94/16477

PCT Pub. Date: Jul. 21, 1994

[51] Int. Cl.[6] ..... H01R 13/648

[52] U.S. Cl. ..... 439/608; 439/108

[58] Field of Search ..... 439/607, 608, 439/609, 95, 108

[56] References Cited

U.S. PATENT DOCUMENTS

| | | | |
|---|---|---|---|
| 3,587,028 | 6/1971 | Uberbacher | 439/608 |
| 4,571,014 | 2/1986 | Robin et al. | 339/14 R |
| 4,632,476 | 12/1986 | Schell | 339/14 R |
| 4,720,770 | 1/1988 | Jameson | 439/609 |
| 4,846,727 | 7/1989 | Glover et al. | 439/608 |
| 4,898,546 | 2/1990 | Elco et al. | 439/608 |
| 4,984,992 | 1/1991 | Beamenderfer et al. | 439/108 |

FOREIGN PATENT DOCUMENTS

| | | |
|---|---|---|
| 0074205 | 3/1983 | European Pat. Off. . |
| 0337634 | 10/1989 | European Pat. Off. . |
| 0446980 | 9/1991 | European Pat. Off. . |
| 59-49173 | 3/1984 | Japan . |

*Primary Examiner*—Hien Vu

*Attorney, Agent, or Firm*—Woodcock Washburn Kurtz Mackiewicz & Norris

[57] ABSTRACT

A connector comprising a body of electrically insulating material having contact holes each provided with an electrical conductive contact element and arranged in at least two columns and at least two rows is provided. Each column has a longitudinal direction. Each contact element comprises a set of contact springs arranged for contacting a contact pin of a mating connector. Shielding elements of electrically conducive plate material being disposed in the body are provided. Each shielding element is shaped and arranged so that neighboring contact elements are always entirely shielded from each other by parts of the shielding elements. The shielding elements are square wave shaped and are each arranged within one column in such a way that an open portion of each of the square wave shaped shielding elements is not adjacent to an open portion of a neighboring square wave shaped shielding element.

6 Claims, 5 Drawing Sheets

CONNECTOR WITH IMPROVED SHIELDING

FIELD OF THE INVENTION

The invention relates to a connector, comprising a body of electrically insulating material comprising contact holes each provided with an electrically conductive contact element, the connector further comprising shielding elements of electrically conductive plate material being disposed in the body.

BACKGROUND OF THE INVENTION

Such a connector is known from U.S. Pat. No. 4,571,014. The known connector comprises several shielding elements of different shape. One of the known shielding elements has a square wave shape which has such dimensions that it encompasses all contact holes. However, neighboring contact elements within contact holes of adjacent rows of contact holes are not shielded from each other by the square wave shaped shielding element. To solve this problem, in the known connector additional shielding plates are applied which are arranged in such way as to shield neighboring contact elements of adjacent rows. These additional shielding plates are provided with appropriate slots to receive the square wave shaped shielding element in order to provide such an entire shielding structure that each contact element is shielded from any neighboring contact element. However, such a combination of shielding elements is complex and the manufacturing of such a connector is complicated.

European patent application 0,074,205 discloses a connector for connecting conductors of coaxially shielded cables to contact pins arranged in one row on a board. Each shielded cable has an external ground terminal of rectangular shape. The contact pins on the board are surrounded by one square-wave shaped contact element, which is shaped in such a way that each "square wave" part may receive one external ground terminal of a shielded cable. No connector having contact holes comprising contact elements and arranged in at least two columns and at least two rows are shown or described. Furthermore, since the external ground terminal of each cable has to be inserted in a "square wave" part of the square wave shaped contact element the dimensions of each of the "square wave" parts are larger than of the outer ground terminals of the cables. This counteracts a design with minimum dimensions.

Further prior art shielding elements may be derived from European patent applications 0,446,980 and 0,337,634 and from U.S. Pat. No. 4,632,476.

Connectors of the type mentioned above are used, for example, for connecting a large number of signal wires to a printed circuit board. To this end, the connector is provided with a number of columns of contact holes with contact members disposed therein, two signal connections and one ground connection being effected, for example, in each column of contact members thus formed. For the purpose of some applications it may be advantageous, however, to form columns of five or more contact holes with contact members disposed therein. Since it is preferable, for example for forming connections to a printed circuit board, to use as small a number of connectors as possible for this purpose, it will often be the case that many signal connections, for example several tens of connectors, are made in one connector. As miniaturization becomes more prevalent, on the one hand, the number of signal wires to be connected to a connector increases, while on the other hand the dimensions of the connector itself must not increase and preferably should even decrease. This results in an increasing number of signal and ground connections in the limited space of the connector. In the case of high-frequency applications, this results inter alia in the risk of cross talk due to mutual electromagnetic interference of the signal connections.

SUMMARY OF THE INVENTION

The object of the invention is to overcome the above-mentioned drawbacks and to provide a connector in which the mutual interference of signal connections is essentially eliminated without fitting supplementary ground connections and without increasing the number of components of the connector. A further object of the invention is to provide a connector, which can be fabricated economically and by means of which, even at high signal frequencies, a large number of connections can be achieved reliably in a relatively small space.

To this end, in the connector according to the invention the shielding elements are square wave shaped and are each arranged within one column, in such a way that each open part of each of the square wave shaped shielding elements is not adjacent to an open part of a neighboring square wave shaped shielding element.

Thus, simple standardized square wave shaped shielding elements may be applied within a connector, the shielding elements being arranged in such a way that none of the contact elements within the contact holes will suffer from electromagnetic interference from any of its neighboring contact elements.

At least one of the shielding elements, for the purpose of contacting a ground contact member of a mating connector, may be provided with a resilient contact member which is integral with the shielding element.

A connector according to the invention may comprise at least one ground pin for the purpose of contacting a ground contact element of a mating connector, the ground pin extending from the connector and being electrically connected to at least one shielding element.

In such a connector the contact elements may be formed by contact pins clamped in the contact holes, thus providing a male type connector.

However, alternatively the contact elements may comprise a set of contact springs arranged for contacting a contact pin of a mating connector, thus providing a female type connector. The male type and female type connectors comprise the same type of square wave shaped shielding elements with equal dimensions, thus supporting the miniaturization of the connectors. The shielding element of a male type connector is not inserted into the shielding element of the female type connector or vice versa but, if connected to each other, the ground pins provide for the ground connection between them.

BRIEF DESCRIPTION OF THE DRAWINGS

The invention will be described below in more detail with reference to the figures.

DETAILED DESCRIPTION OF PREFERRED EMBODIMENTS

Figure 1:
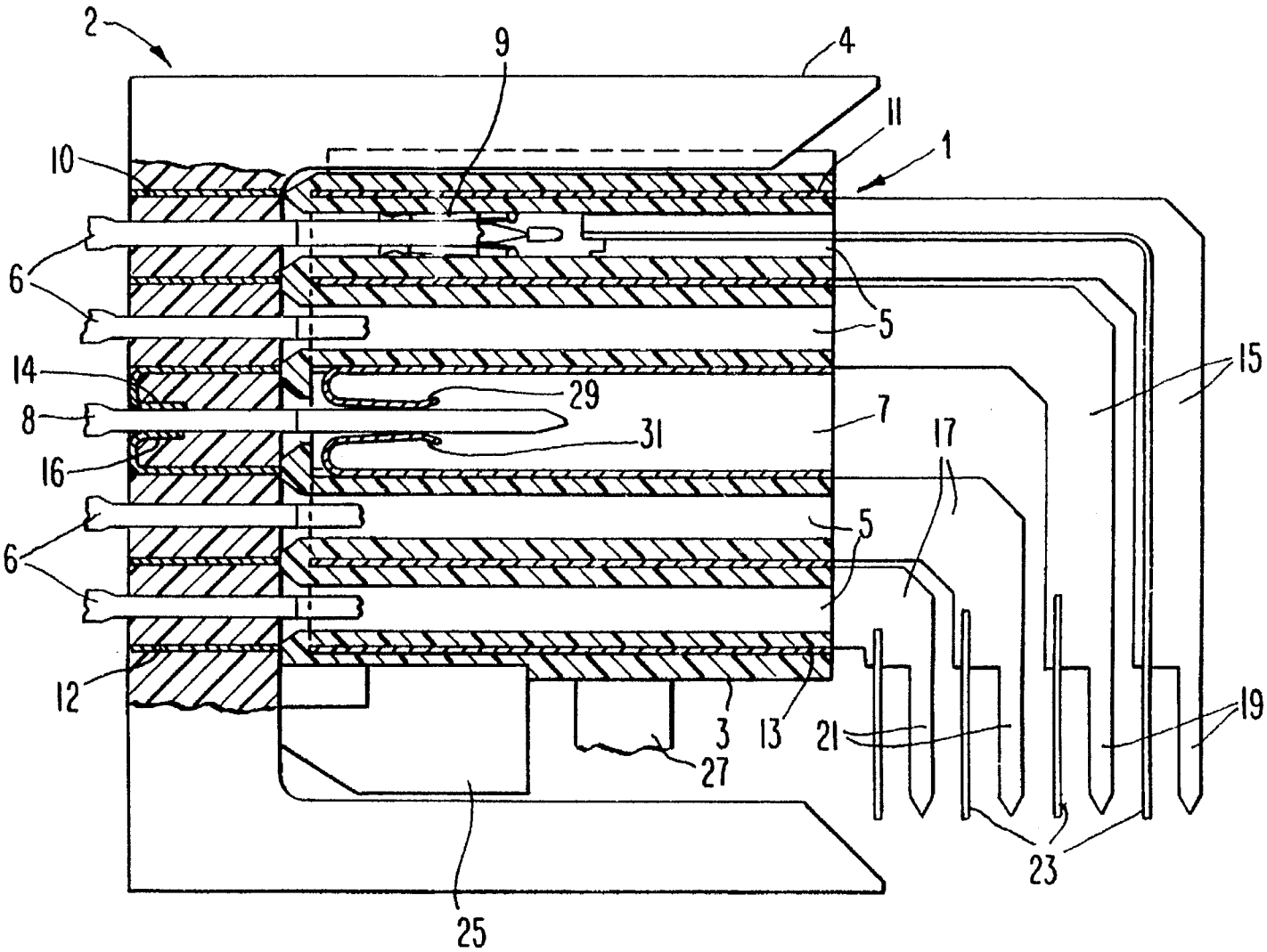
FIG. 1 shows a side view in partial Cross-Section of a connector assembly according to the invention.

FIG. 1 shows, by way of example, a connector assembly according to the invention for use with a printed circuit board. The connector assembly comprises a female connector 1 and a male connector 2. The female connector 1 comprises a body 3 having, in the illustrative embodiment shown, continuous contact holes 5 and 7, the contact holes 5 serving to form signal connections and the contact hole 7 serving to form a ground connection.

Received in the contact holes 5 of the female connector 1 are female contact members 9, of which for the sake of clarity of the drawing only one is shown. Disposed in the contact hole 7 are contact members for forming a ground connection, which further contact members will be explained below in more detail. In the illustrative embodiment shown, a column of contact holes comprises five contact holes, namely four contact holes 5 and one contact hole 7, the column of contact members comprising four signal contact members in the holes 5 and one ground contact member in the hole 7. It will be evident, however, that other configurations can equally be employed, for example columns having three, six or more contact members.

In the body 3 of the female connector 1, a first shielding element 11 and a second shielding element 13 are further disposed. In order to achieve optimum shielding of the contact members with respect to one another and with respect to components situated outside the connector, the shielding elements 11 and 13 extend over virtually the whole length of the body 3. As will be explained in more detail with reference to FIG. 2, the shielding elements 11 and 13 in this instance extend both in the plane of the drawing and transversely to the plane of the drawing. In the plane of the drawing, the shielding elements 11 and 13 comprise shielding strips 15 and 17, respectively, which terminate in ground-connection lugs 19 and 21, respectively. The shielding strips 15 and 17 run parallel to signal-connection lugs 23, which, for the sake of clarity of the drawing, are shown only in part and which are connected to the contact members 9. Although in the illustrative embodiment shown no mutual vertical shielding is provided of those parts of the connecting lugs 23 which are outside the body 3, the presence of air instead of plastic between the signal connections in most cases provides a sufficient degree of insulation, so that there is virtually no mutual interference between the signal connections. It is therefore advantageously possible to dispense with vertical (in the drawing) shielding.

The female connector 1 is further provided with a positioning member 25 for positioning the body 3 in the body 4 of the male connector 2, and with a mounting pin 27 (shown only in part) for mounting the female connector 1 on a printed circuit board (not shown).

The body 4 of the male connector 2 is provided with signal contact pins 6, electrically insulated with respect to one another, and a ground-contact pin 8. Between the contact pins, and electrically insulated with respect thereto, a first shielding element to and a second shielding element 12 are disposed which, as will be explained in more detail with reference to FIG. 5, like the shielding elements 11 and 13 extend both in the plane of the drawing and transversely thereto. For the purpose of contacting the ground-contact pin 8, the first shielding 10 and the second shielding 12 of the male connector 2 are provided with contact lugs 14 and 16, respectively. In this context, the body 4 and the contact lugs 14 and 16 are designed in such a way that the contact pin 8 is firmly clamped between the contact lugs 14 and 16, thus ensuring good electrical contact therebetween. As a result of this electrical contact, the shieldings 10 and 12 are connected to one another and, via the contact pins 8, to ground. The contact lugs 14 and 16 form one whole plate with the shielding element 10 and the shielding element 12, respectively, a very simple and effective construction being achieved thereby.

Similarly, the first shielding element 11 and the second shielding element 13 of the female connector are provided with a contact lug 29 and a contact lug 31, respectively, for contacting the ground-contact pin 8. As will be explained in more detail with reference to FIGS. 3 and 4, the contact lugs 29 and 31 form one whole plate with the shielding elements 11 and 13, respectively. The contact lugs 29 and 31 form a further ground-contact member disposed in the contact hole 7. As it must be possible to disconnect the male and female connectors, the contact lugs 29 and 31, compared to the contact lugs 14 and 16, exert a relatively light contact pressure. In order to ensure good electrical contact by a relatively light contact pressure, the contact lugs 29 and 31 are designed to be slightly curved near their ends.

Figure 2:
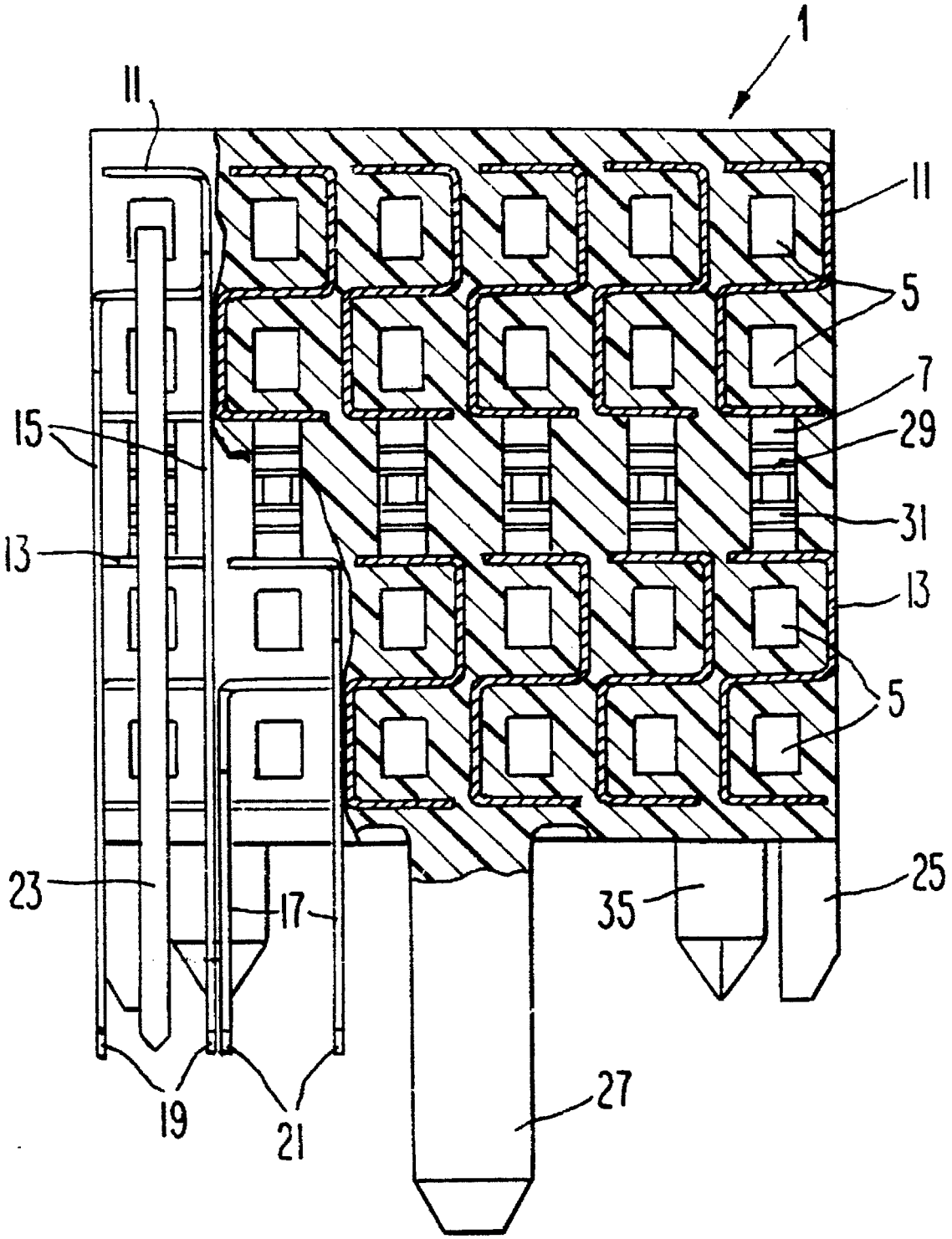
FIG. 2 shows a rear view of the female connector of FIG. 1.

In FIG. 2 the female connector 1 of FIG. 1 is shown in rear view and in a partially sectional view. The embodiment shown of the connector according to the invention comprises six columns of contact holes 5 and 7. For each column of contact holes, a shielding element 11 or 13, respectively, is disposed which encloses the contact holes 5 at least partially. The shielding elements, in the illustrative embodiment shown, have a shape which approximately corresponds to the digit 2 or the mirror image of the letter 5. Owing to this shape, each contact hole 5 is surrounded on at least three sides, and is thus shielded, while the shielding element of an adjacent column of contact holes provides shielding on a fourth side. At the same time, the contact holes 5 are shielded from the contact holes 7 by the, in the drawing, horizontal and lowest sections of the shielding elements 11 and the horizontal and topmost sections of the shielding elements 13. As a result, using a relatively very small number of components a very effective mutual shielding of the contact holes and the contact members accommodated therein is achieved. Supplementary to the parts described earlier with reference to FIG. 1, FIG. 2 shows aligning members 35, which facilitate the alignment and centering of the female connector 1 on a printed circuit board (not shown) provided with centering holes.

Figure 3:
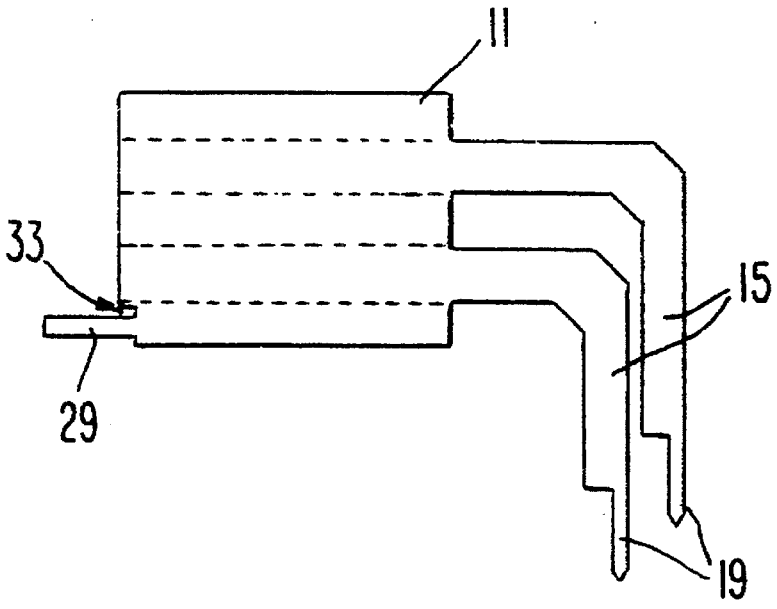
FIG. 3 shows a flat of a shielding element according to the invention.

FIG. 3 shows a flat of a shielding element 11, the folding lines, about which the flat must be folded to achieve the shape illustrated in FIGS. 1 and 2, being indicated by broken lines. The shielding strips 15, which are provided with connecting lugs 19, like the contact lug 29 form one whole plate with the shielding element 11. In order to facilitate folding over of the contact lug 29 and reduce the risk of the plate material tearing, the shielding element 11 is preferably provided with a notch 33. It will be evident that the shielding element 13 has a corresponding shape, the dimensions of the shielding strips 17 being smaller, however, than those of the shielding strips is of the shielding element 11, and the contact spring 31 being disposed in a different position. The shielding elements 10 and 12 may be formed in a corresponding manner from flat plate material.

Figure 4:
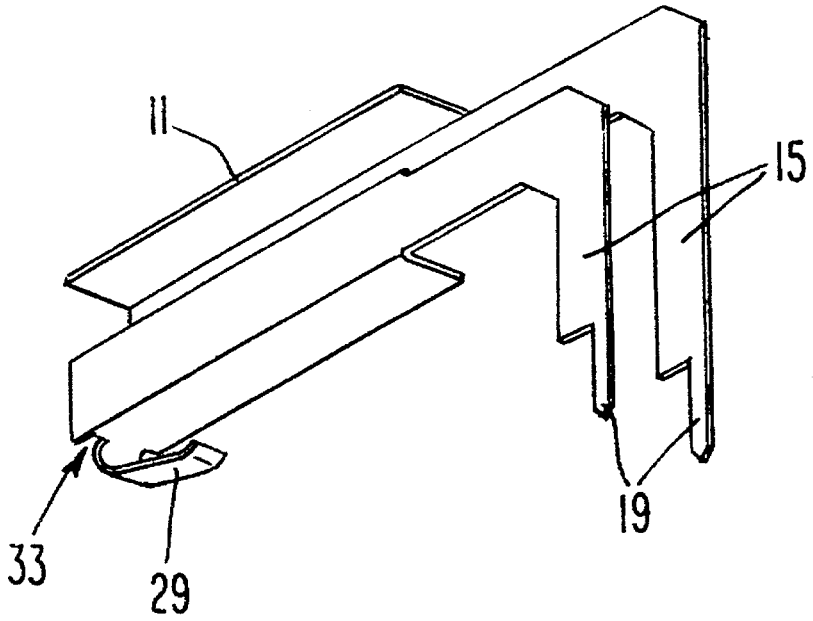
FIG. 4 shows a shielding element according to the invention in perspective.

In FIG. 4, the shielding element 11 of FIG. 3 is shown perspectively in the folded state. It can likewise be clearly seen from FIG. 4 that the contact lug 29 forms one whole plate with the shielding element 11, which makes it unnecessary to fit the shielding element 11 with a separate supplementary contact member for contacting a ground connection, such as a contact pin 8.

Figure 5:
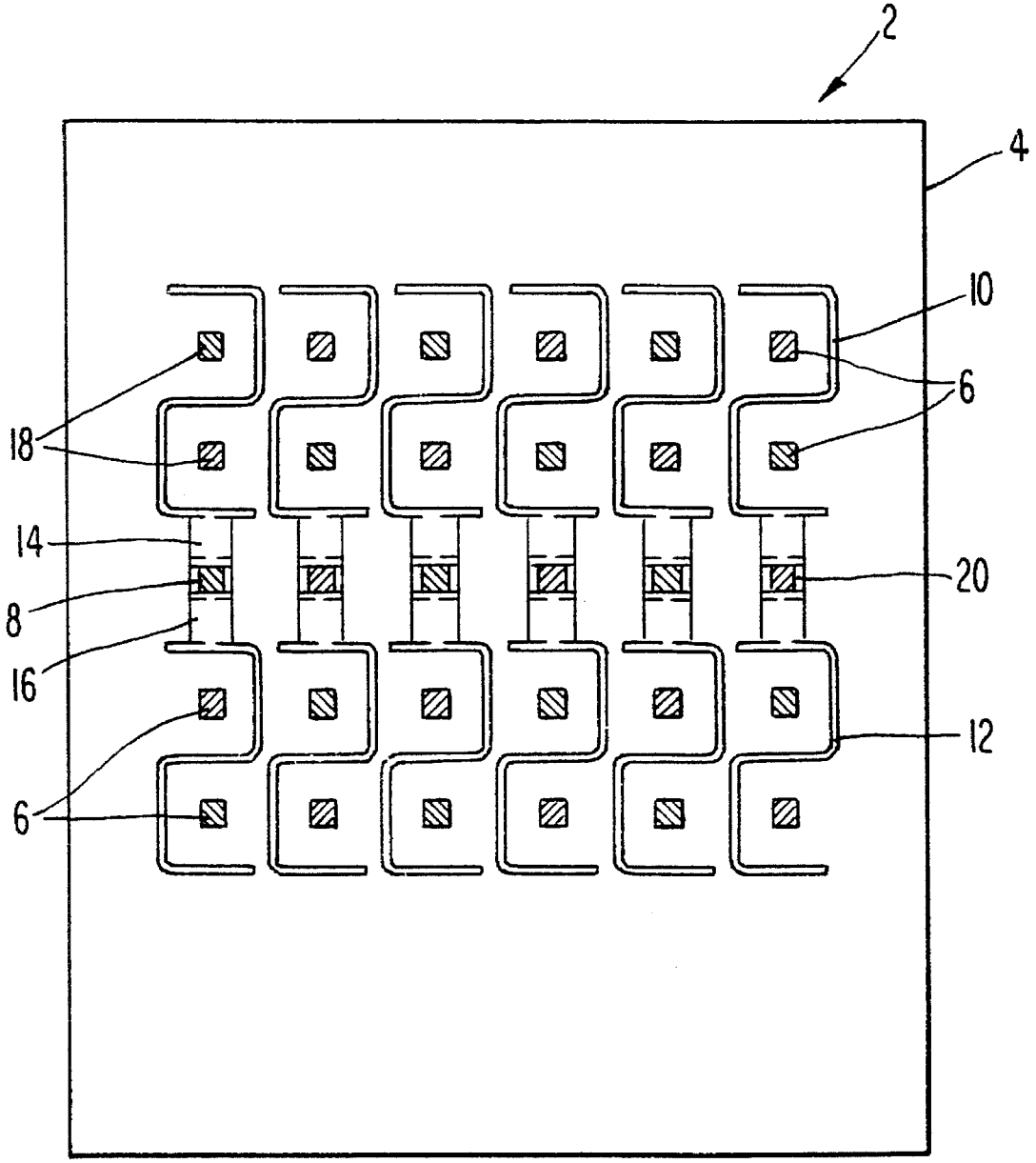
FIG. 5 shows the male connector of FIG. 1 in front view.
Figure 6A:
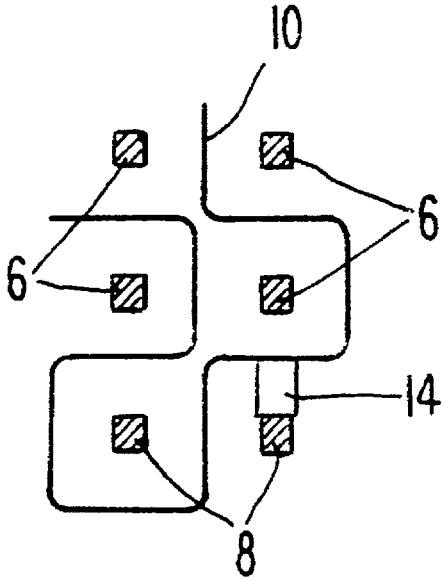
FIG. 6 shows further embodiments of the shielding element according to the invention.
Figure 6B:
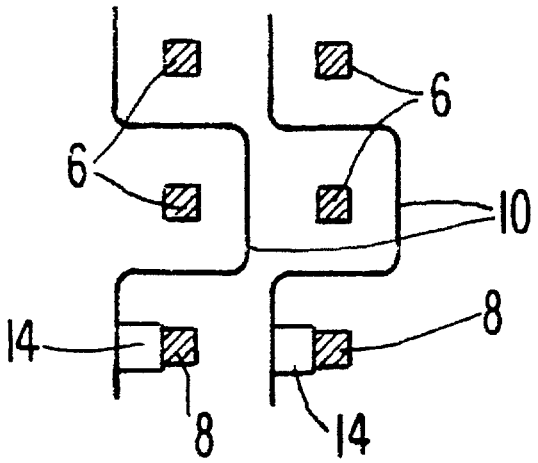
Figure 6C:
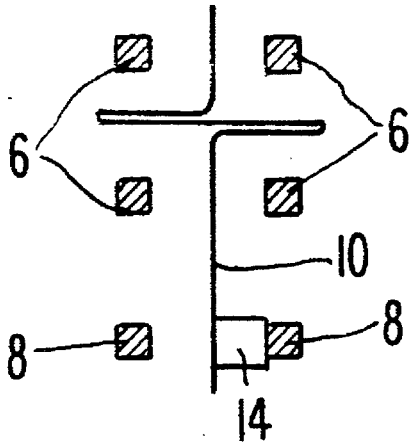
Figure 6D:
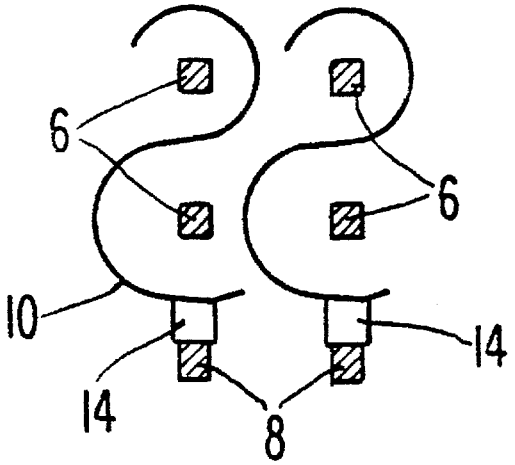

FIG. 5 shows the male connector 2 of FIG. 1 in front view, the contact pins 6 and 8 being shown in a sectional view. The body 4 is provided with contact holes 18 and 20, which accommodate the contact pins 6 and 8, respectively. The shielding elements 10 and 12, in the embodiment shown, have a shape which roughly corresponds to the digit 2 or the mirror image of the letter 5. Owing to this shape, good mutual shielding is achieved for all contact holes, using a minimum number of components, while the mechanical strength of the body 4 is not affected. The assembly of the body 4 (or 3, respectively) and the shielding elements 10 and 12 (or 11 and 13, respectively), can be achieved either by fitting the body with grooves, into which the shielding elements are pushed subsequently, or by forming the body directly around the shielding elements, for example by injection molding. As can also be seen from FIG. 1, the contact lugs 14 and 16 form one whole plate with the shielding elements 10 and 12, respectively.

FIG. 6 illustrates diagrammatically several other possible shapes of the shielding elements 10, 11, 12 and 13. With reference to the shielding element 10 by way of example, FIG. 6*a* shows how a single shielding element 10 can be used to achieve shielding of the contact pins 6 of two columns. In this case the contact spring 14 contacts the ground-contact pin 8 in the contact hole 20 at the top. FIG. 6*b* shows an embodiment, in which the contact pin 8 disposed in the contact hole 20 is contacted laterally. In FIG. 6*c*, the ground-contact pin 8 is likewise contacted laterally. While this embodiment does provide mutual shielding of the contact pins 6, the lowermost contact hole is not shielded with respect to the contact pins 8. As the contact pin a is a ground pin, this does not present a problem. FIG. 6*d* shows how a more rounded shape can be used to obtain effective shielding, while achieving at the same time an advantageous impedance value. It will be evident that other embodiments of the shielding elements and of the connectors are possible without departing from the scope of the invention. Thus the invention can also be used in connectors which are not equipped for mounting on a printed circuit board. Likewise, the shielding elements, which in the embodiments shown are positioned mainly vertically, may extend mainly horizontally instead of vertically. Using the shielding elements according to the invention, effective shielding will always be achieved in a simple manner.

What is claimed is:

1. An electrical connector comprising:

a body of electrically insulating material having contact holes, each of said contact holes provided with an electrical conductive contact element, and said contact holes arranged in at least two columns and at least two rows, said columns having a longitudinal direction, said contact element being arranged for contacting a contact pin of a mating connector; and shielding elements of electrically conductive plate material being disposed in said body, said shielding elements being shaped and arranged so that neighboring contact elements are always entirely shielded from each other by parts of said shielding elements, wherein said shielding elements are square wave shaped and are each arranged within one column in such a way that an open portion of each of said square wave shaped shielding elements is not adjacent to an open portion of a neighboring square wave shaped shielding element, and wherein at least one of said shielding elements being provided with a resilient contact member which is integrally formed with said shielding element for the purpose of contacting a ground contact member of the mating connector.

2. An electrical connector according to claim 1, wherein said resilient contact member near its end is provided with a curved contact surface.

3. An electrical connector according to claim 1 further comprising at least one ground pin for the purpose of contacting a ground contact element of the mating connector, said ground pin extending from the connector and being electrically connected to at least one shielding element.

4. An electrical connector according to claim 1, wherein a plurality of shielding elements are disposed in a column of contact holes.

5. An electrical connector according to claim 1, wherein the mating connector further comprising contact pins, said contact pins being clamped in electrical communication with said contact members within said contact holes.

6. An electrical connector according to claim 1, wherein each contact element comprises a set of contact springs arranged for contacting a contact pin of the mating connector.

* * * * *